US012150577B2

(12) United States Patent
Boyanich

(10) Patent No.: US 12,150,577 B2
(45) Date of Patent: Nov. 26, 2024

(54) POST SHIELD

(71) Applicant: Joseph E. Boyanich, Medina, NY (US)

(72) Inventor: Joseph E. Boyanich, Medina, NY (US)

( * ) Notice: Subject to any disclaimer, the term of this patent is extended or adjusted under 35 U.S.C. 154(b) by 85 days.

(21) Appl. No.: 18/153,024

(22) Filed: Jan. 11, 2023

(65) Prior Publication Data

US 2024/0225333 A1 Jul. 11, 2024

(51) Int. Cl.
*A47G 29/12* (2006.01)

(52) U.S. Cl.
CPC ..... *A47G 29/1216* (2013.01)

(58) Field of Classification Search
CPC ..... A47G 29/1216; A47G 29/1209; A47G 29/122; E01F 7/02; E01F 7/00
See application file for complete search history.

(56) References Cited

U.S. PATENT DOCUMENTS

| | | | | |
|---|---|---|---|---|
| 3,605,851 | A | 9/1971 | Miles et al. | |
| 4,187,978 | A | 2/1980 | Dowker | |
| 4,491,166 | A | 1/1985 | Hanna | |
| 5,425,501 | A | 6/1995 | Wesorick | |
| 5,460,326 | A | 10/1995 | Albanesius | |
| 5,848,502 | A | 12/1998 | Schaefer | |
| 5,903,992 | A | 5/1999 | Eisenberg | |
| D438,125 | S | 2/2001 | Kaposi et al. | |
| 6,543,164 | B1 | 4/2003 | Sperl et al. | |
| 6,807,782 | B2 | 10/2004 | Forman et al. | |
| 6,824,113 | B1 | 11/2004 | Gee et al. | |
| 6,962,460 | B1 | 11/2005 | Pratt | |
| 7,080,773 | B1 | 7/2006 | Tepley | |
| 7,364,066 | B1 | 4/2008 | Wilson | |
| 7,611,043 | B2 | 11/2009 | Black | |
| 7,611,044 | B1 | 11/2009 | Wilson | |
| 8,794,505 | B1 * | 8/2014 | Richardson | A47G 29/1203 232/1 C |
| 8,925,225 | B2 | 1/2015 | Fiore | |
| 9,549,632 | B2 * | 1/2017 | Pickens | A47G 29/1216 |
| 10,022,007 | B1 * | 7/2018 | Lucero | G09F 7/18 |
| 10,448,772 | B1 | 10/2019 | Fiore | |

(Continued)

OTHER PUBLICATIONS

Virgina Department of Transportion Land Use Permit—Mailbox Installation Guidelines; 3 pages, date unknown, was publicly available prior to Jan. 1, 2022.

(Continued)

*Primary Examiner* — William L Miller
(74) *Attorney, Agent, or Firm* — Roach Brown McCarthy & Gruber, P.C.; Kevin D. McCarthy

(57) ABSTRACT

A post shield to protect a mailbox and a post from damage caused by snowplows, snow, sleet, ice, or combinations thereof. The post shield has a base support, at least one post shield board, and an upper frame support that are interconnected to the post to create a post shield. The base support has (1) a front plate, (2) a rear plate capable of being positioned a post shield distance from the front plate to form a shield aperture, wherein the post shield distance permits the post shield board to be (a) removably received between the front plate and the rear plate and (b) essentially vertically leveled when positioned in the base support, and (3) a frame base capable of receiving a portion of the corresponding post. The post shield board and the post each have at least one upper frame slot that receive the upper frame support.

17 Claims, 13 Drawing Sheets

(56) References Cited

U.S. PATENT DOCUMENTS

| | | | | |
|---|---|---|---|---|
| 11,118,319 | B2 | 9/2021 | Battjes et al. | |
| 11,352,754 | B2 * | 6/2022 | Parker, III | E01F 7/02 |
| 2006/0186188 | A1 * | 8/2006 | Belanger | A47G 29/1209 232/38 |
| 2008/0314967 | A1 * | 12/2008 | Black | A47G 29/1216 232/39 |
| 2010/0243977 | A1 * | 9/2010 | Middlebrook, Jr. | E01F 7/00 256/12.5 |
| 2014/0069996 | A1 * | 3/2014 | Pickens | A47G 29/1216 232/17 |

OTHER PUBLICATIONS

Mail Boss Locking security mailboxes instructions, 2 pages, Mar. 30, 2021.

* cited by examiner

POST SHIELD

FIELD OF THE INVENTION

A post shield protects a mailbox from being damaged during a wonderful winter season.

BACKGROUND OF THE INVENTION

A mailbox is designed to receive mail from a mail carrier. In many suburban and rural communities, a mailbox is positioned (a) on a corresponding post, (b) near, across the street, or on the mailbox owner's property and (c) near a roadside. According to the US Postal Service, the mailbox should have a Postmaster General's (PMG) seal of approval since it meets US Postal Service size and construction standards. The US Postal Service also asserts the mailbox should be positioned "41" to 45" from the road surface to the bottom of the mailbox or point of mail entry; and 6" to 8" back from the curb.

And the best mailbox supports or mailbox post are stable but bend or fall away if a car hits them. The Federal Highway Administration recommends the mailbox supports: [a] be a 4"×4" wooden support or a 2"-diameter standard steel or aluminum pipe; [b] avoid being unyielding and potentially dangerous supports, like heavy metal pipes, concrete posts, and farm equipment (e.g., milk cans filled with concrete); and should be buried no more than 24" deep. The Virginia Department of Transportation's Mailbox installation guidelines confirm that the post should be buried no more than 24" deep and assert that any anti-twist devices that extends no more than 10" below the ground surface is acceptable.

To achieve those objectives regarding the mailbox and the mailbox post, common instructions recommend:

"With a shovel or post digger, dig a hole centered 16 to 18 inches from the street. The hole should be dug 12 inches below the level of the street" for boring climate areas; but if one lives in an exciting and "very cold climate . . . [there is a recommendation the hole be] at least 2 feet deep". Stand the post in the hole and verify that the post's top surface is about 31 inches above the level of the street. Thus, if the post is 43 inches and the hole is 12 inches deep below the street level; then the post extends 31 inches above the street level. Obviously if the post is longer, the hole can be dug deeper or the post can be cut to the desired height on the condition that the post should extend about 31 inches above the street level. Once the post is standing, the post needs to vertically leveled." Once the post is leveled, and the post's top surface is about 31 inches above the street level; then the mailbox can be attached.

The mailbox has a front side with a latch door. The mailbox's front side is supposed to face the street so the mail carrier can open the latch door and insert mail into the mailbox. The mailbox's front side, as defined above, should be 6 inches to 8 inches from the street while the mailbox should be about 41 inches to 45 inches above the street surface. That way, a mail carrier can drive up to the mailbox, deliver mail to the mailbox without getting out of a vehicle, and occasionally hit the mailbox or corresponding post without, hopefully, significant damage to the vehicle and the mail carrier.

During a wonderful winter season, the roads are covered, hopefully, daily by beautiful snow that measures 10 cm or more—preferably more for a spectacular powder day. When it snows that much, local authorities—but not in Wyoming—normally have road crews drive snowplows wherein the snowplows are capable of moving, at least a majority of, the snow from the streets. When the streets are snowplowed, snow is normally pushed toward a roadside and accumulates on the roadside. Under desirable winter circumstances, roadside snow can accumulate to about 1 meter or more. When more fresh snow falls, the snowplows are able to push the fresh snow into, onto, and/or over the existing roadside snow. Snowplows are also capable of pushing (a) fresh snow, (b) existing roadside snow, or (b) combinations thereof toward a mailbox and a corresponding post. When a snowplow moves any snow; the snowplow and/or the snow is capable of (a) damaging the mailbox, the corresponding post, or combinations thereof; or (b) covering the mailbox. A mail carrier can have difficulty delivering mail when the mailbox is damaged or covered, or the corresponding post is damaged. To decrease that problem, numerous patents have been obtained to address that problem.

In U.S. Pat. No. 11,118,319; Battjes et al. illustrate a classic mailbox protector that uses two independent posts, wherein a first post secures the mailbox in place in accordance with the US Postal Service's mailbox installation guidelines and a second post has a V-shaped post shield (a.k.a., deflection surface) that only protects the mailbox. That mailbox protector is practical in unbearable climates like the District of Columbia wherein the average snowfall is less than a meter and summers are hot, dreadful, and humid.

In U.S. Pat. No. 10,448,772; Fiore discloses post shield protector having an angular deflection surface. The angular deflection surface has a first planar deflection panel and a second planar deflection panel contiguous along a linear vertex. The linear vertex is directed toward, for example, oncoming traffic to deflect impacting snow away from a mailbox. The impacting snow may come from passing snowplows, for instance. The post shield protector has a receiving channel. The receiving channel is located in the linear vertex extending through the angular deflection surface device from the linear vertex's top end opening to linear vertex's bottom end opening. The receiving channel receives a fence post to anchor the angular deflection surface device in the ground. See, abstract. Fiore discloses the angular deflection device can also have fastener apertures wherein the fastener apertures interconnect to fasteners in order to inhibit the deflection device from rotating about the receiving channel. Fiore's post shield protector is practical in an environment that gets snow infrequently—like Ohio or Texas—but is impractical in an area that averages over a meter of snow annually. It is impractical because a plow, the plowed snow, and the existing roadside snow will damage the fasteners and/or apertures and render Fiore's post shield inoperable since the post shield will then rotate about the fence post—assuming the fence post is not damaged and the linear vertex is not damaged. In addition, Fiore's post shield protector does not abide to the US Postal Service's recommended standards because the post shield protector is secured into position by a fence post and unknown fasteners that could damage the mail vehicle or other vehicles more than just the corresponding post.

In U.S. Pat. No. 8,925,225; Fiore disclosed an angular deflection panel. This angular deflection panel has a first planar deflection panel and a second planar deflection panel, and a linear vertex between the first and second planar deflection panels. The angular deflection panel has a first, second, and third male anchor affixed by fasteners from a top surface to the bottom surface to, respectively, (i) the first panel's distal end, (ii) the second panel's distal end and (iii) the linear vertex. Each male anchor has a fixed post section extending downward from, respectively, the first panel's distal end and bottom surface; (ii) the second panel's distal end and bottom surface, and (iii) the linear vertex's bottom surface; and a sliding post extending downwardly, respectively, from (i) first fixed post, (ii) the second fixed post, and (iii) the third fixed post. Each male anchor is positioned in a female anchor member, and no part of the angular deflection panel is positioned in any female anchor member.

Fiore's angular deflection panel does not abide to the US Postal Service's recommended standards because angular deflection panel is secured into position by three anchors. Each anchor is securely set in the ground and extends to the angular deflection panel's top surface in three distinct locations. Those anchors could damage the mail vehicle or other vehicles more than just the corresponding post.

The current invention attempts to address the above-identified problems.

SUMMARY OF THE INVENTION

A post shield designed to protect a mailbox and a corresponding post from damage caused by snowplows, snow, sleet, ice, or combinations thereof. The post shield has a base support, at least one post shield board, and an upper frame support that are interconnected to the corresponding post to create a post shield that should not violate US Postal Service's or the Federal Highway Administration's rules, regulations, recommendations. The base support has (1) a front plate, (2) a rear plate capable of being positioned a post shield distance from the front plate to form a shield aperture, wherein the post shield distance permits the post shield board to be (a) removably received between the front plate and the rear plate and (b) essentially vertically leveled when positioned in the base support, and (3) a frame base capable of receiving a portion of the corresponding post. The post shield board and the corresponding post each have at least one upper frame slot that receive the upper frame support.

DETAILED DESCRIPTION OF THE INVENTION

Figure 1:
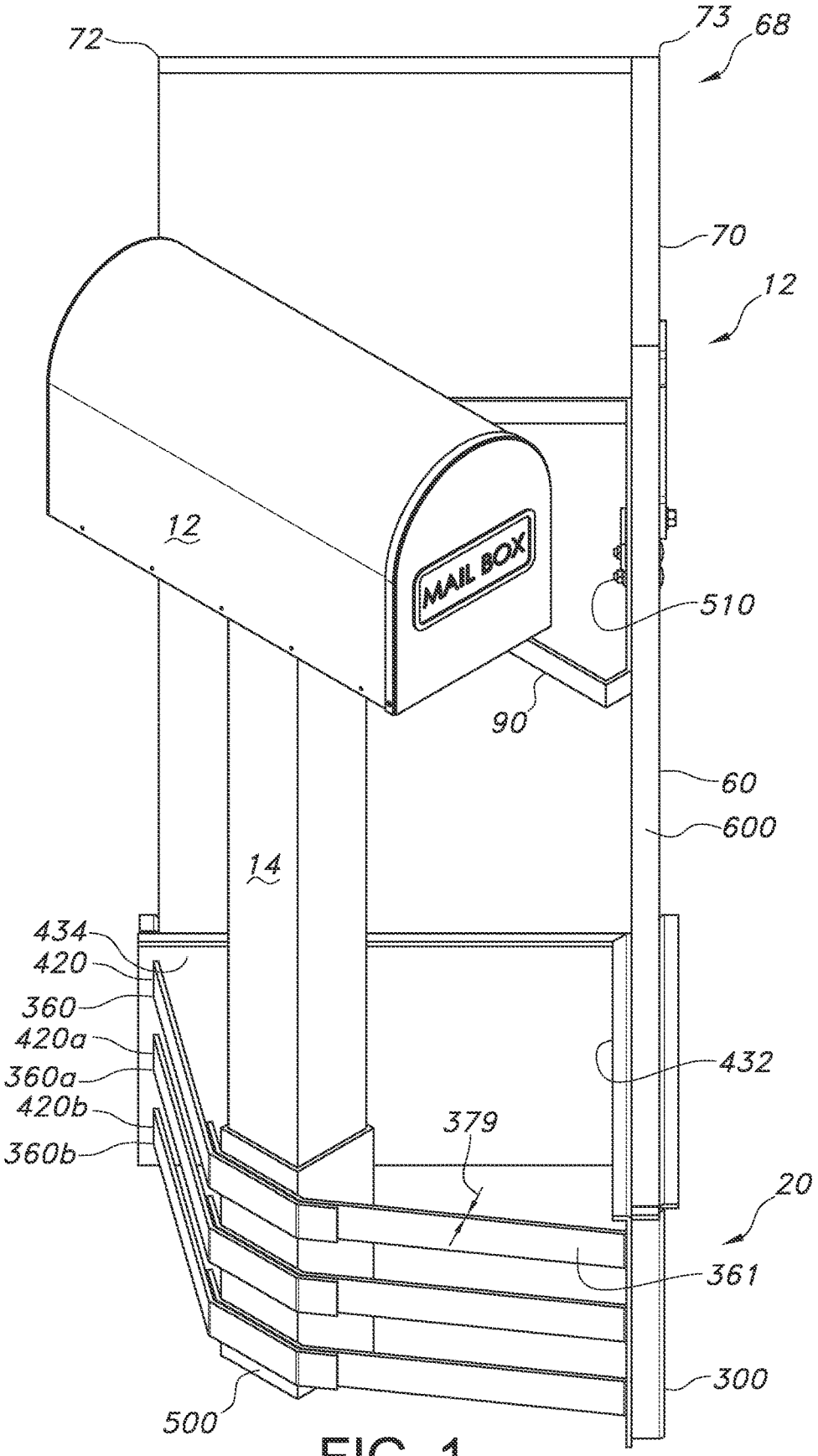
FIG. 1 is a front, non-traffic side, isometric view of a mailbox, a corresponding post, and a post shield as viewed from a street.

A post shield 10 is designed to protect a mailbox 12 and a corresponding post 14 as illustrated at FIG. 1 from damage caused by snow, sleet, ice, or combinations thereof being pushed or pulled toward the mailbox 12 during (a) an awesome and deep snow season (more than three meters of snow) or (b) a boring, dark, gloomy, dreary winter season (less than one meter of snow). An awesome and deep snow season results in a roadside snowbank averaging over one meter for more than 2 weeks a year.

Mailbox and Post

The mailbox 12 and corresponding post 14 as shown in FIG. 1, and position of the mailbox 12 and corresponding post 14 in relation to a road, should comply with the US Postal Service's, respective State rules and regulations, and/or the Federal Highway Administration's rules, regulations, recommendations regarding mailboxes, and posts. Those requirements are disclosed in the above-identified background of the invention.

Post Shield

Figure 2:
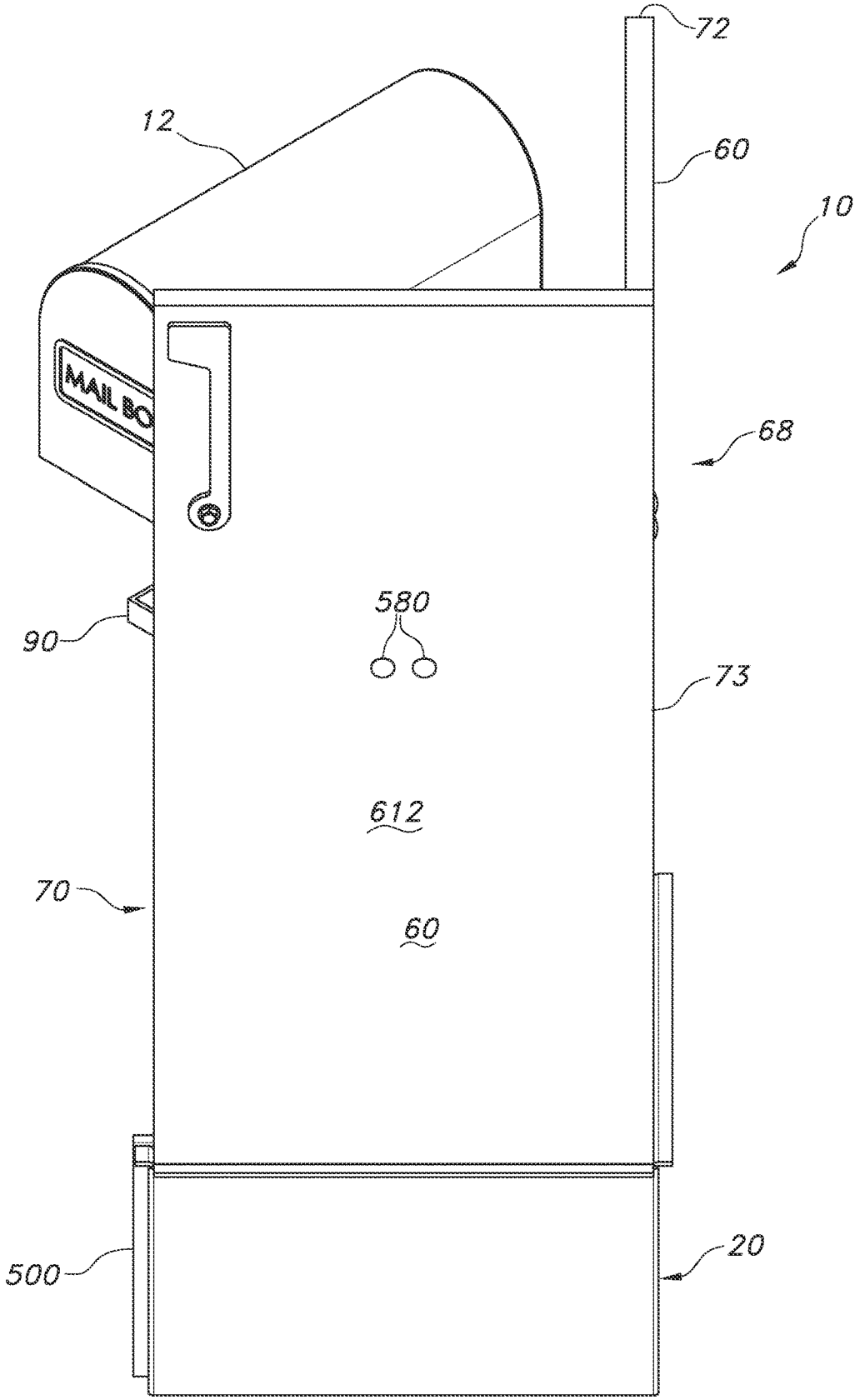
FIG. 2 is a front, traffic side, isometric view of FIG. 1.

The post shield 10, as shown at FIGS. 1 and 2, has a base support 20, at least one post shield board 60, and an upper frame support 90. The base support 20, at least one post shield board 60, and an upper frame support 90 can be, respectively, made of metal, plastic, wood, concrete, or combinations thereof.

Figure 3:
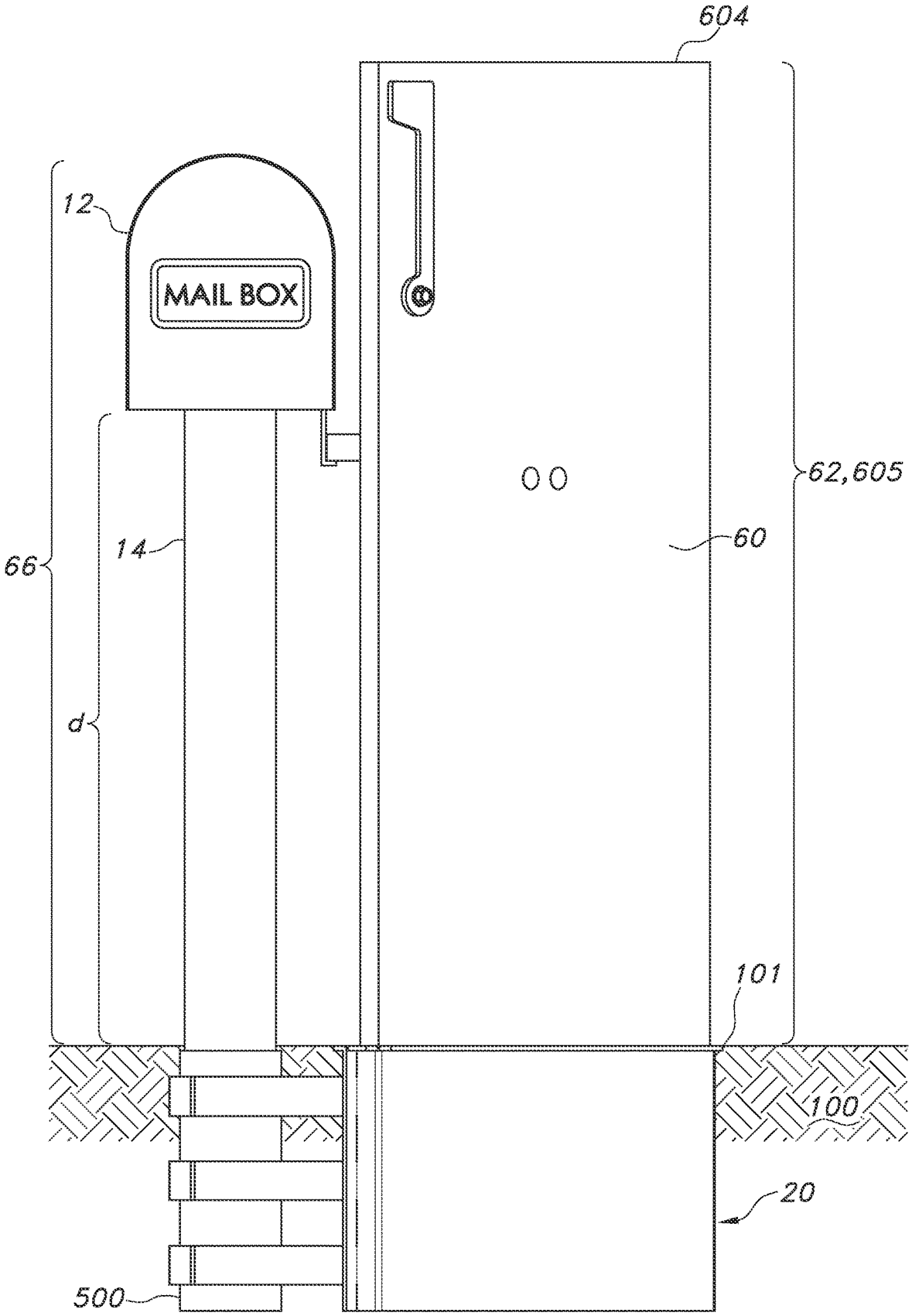
FIG. 3 is a front view of FIG. 1 in relation to a supporting substrate.
Figure 4:
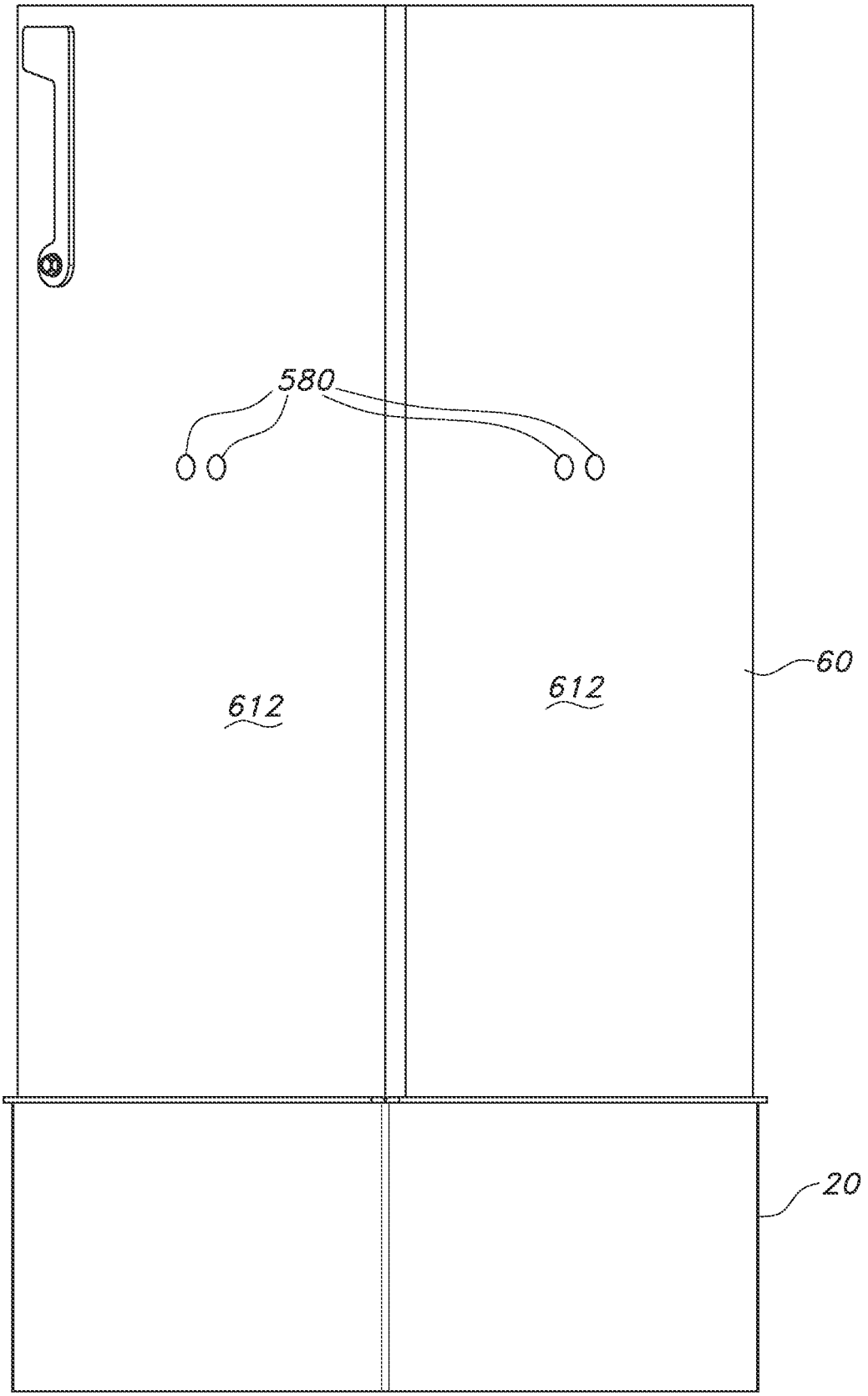
FIG. 4 is a traffic side view of FIG. 1.
Figure 5:
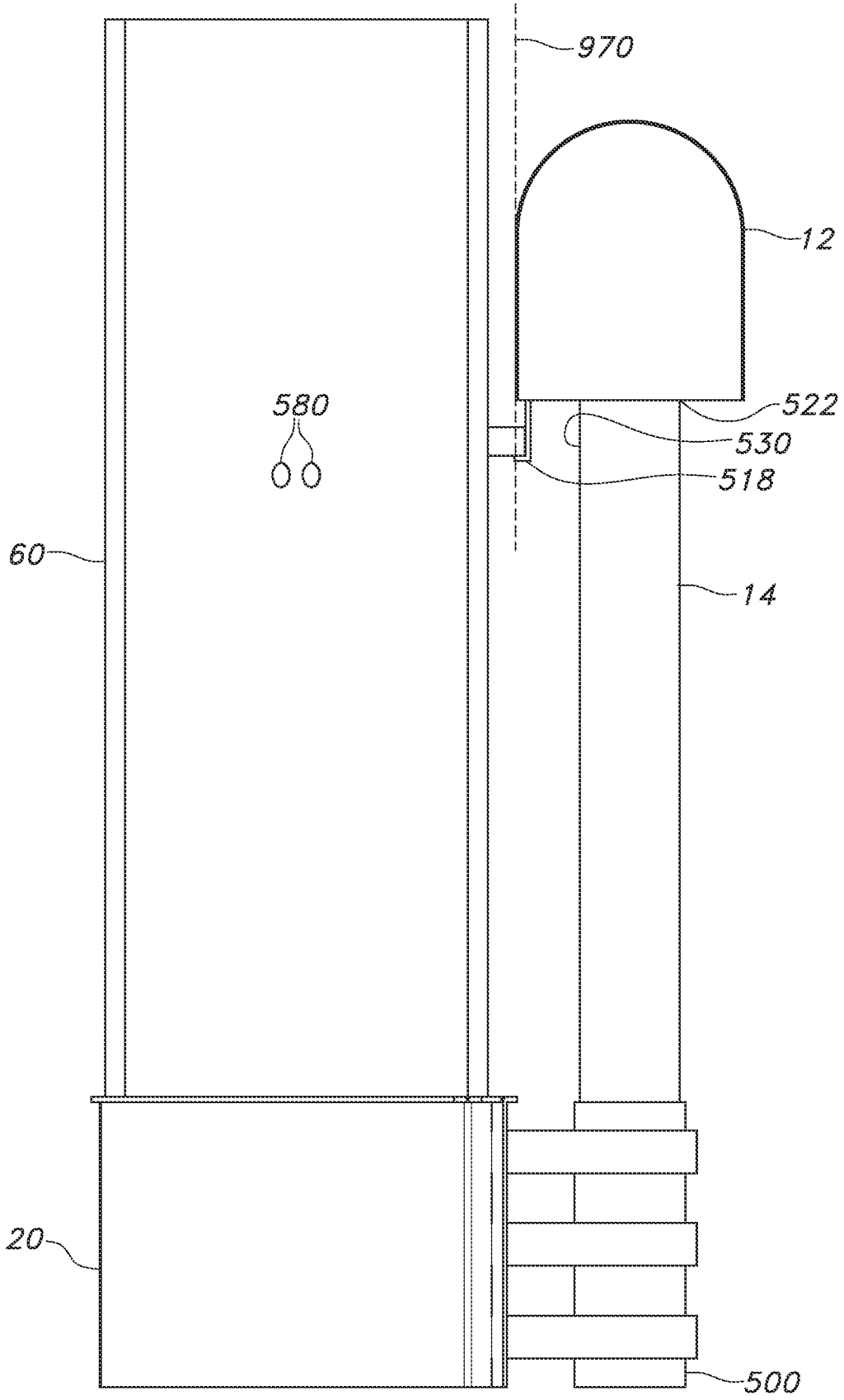
FIG. 5 is back side view of a FIG. 1.
Figure 6:
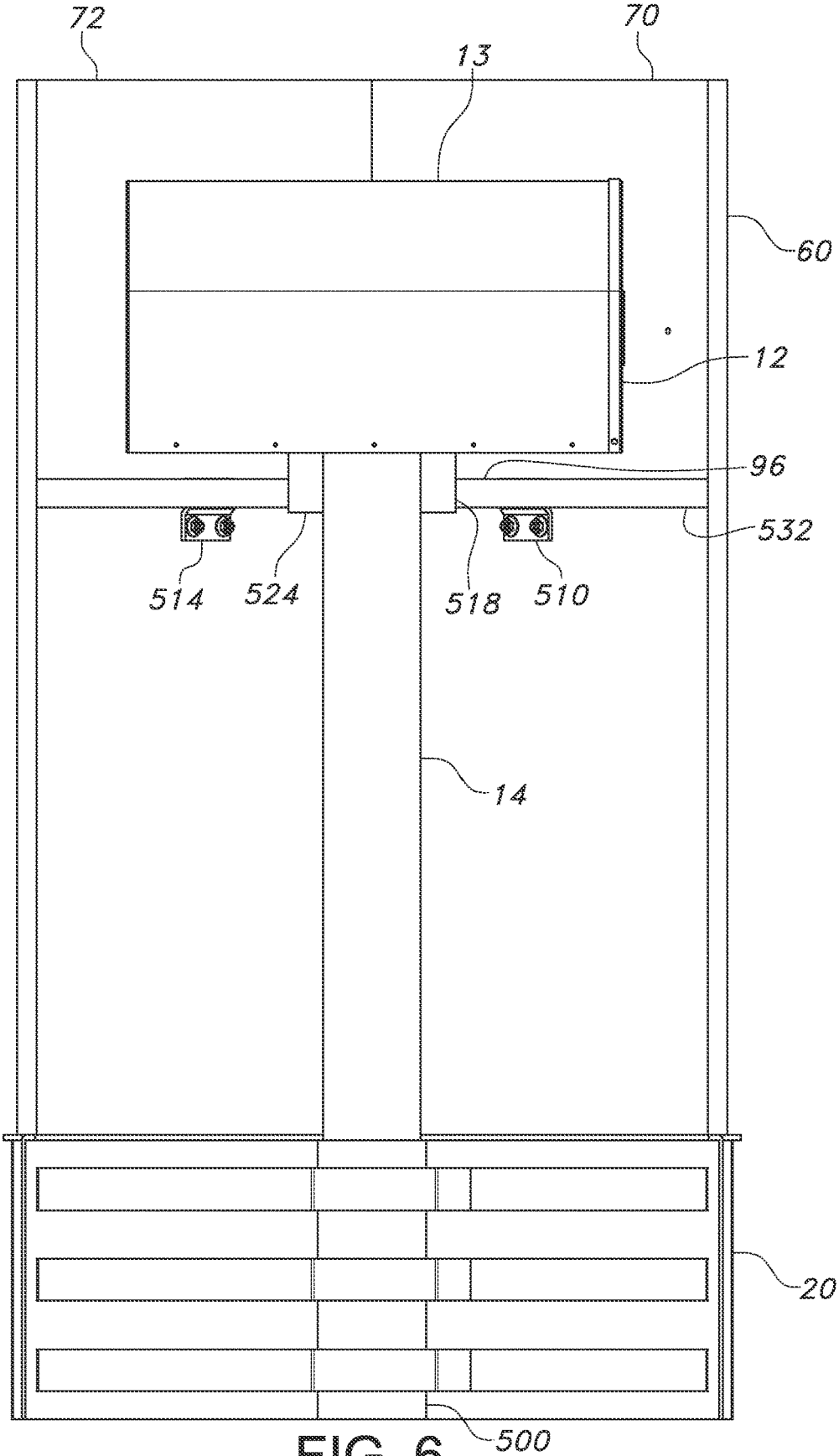
FIG. 6 is a non-traffic side view of FIG. 1.
Figure 7:
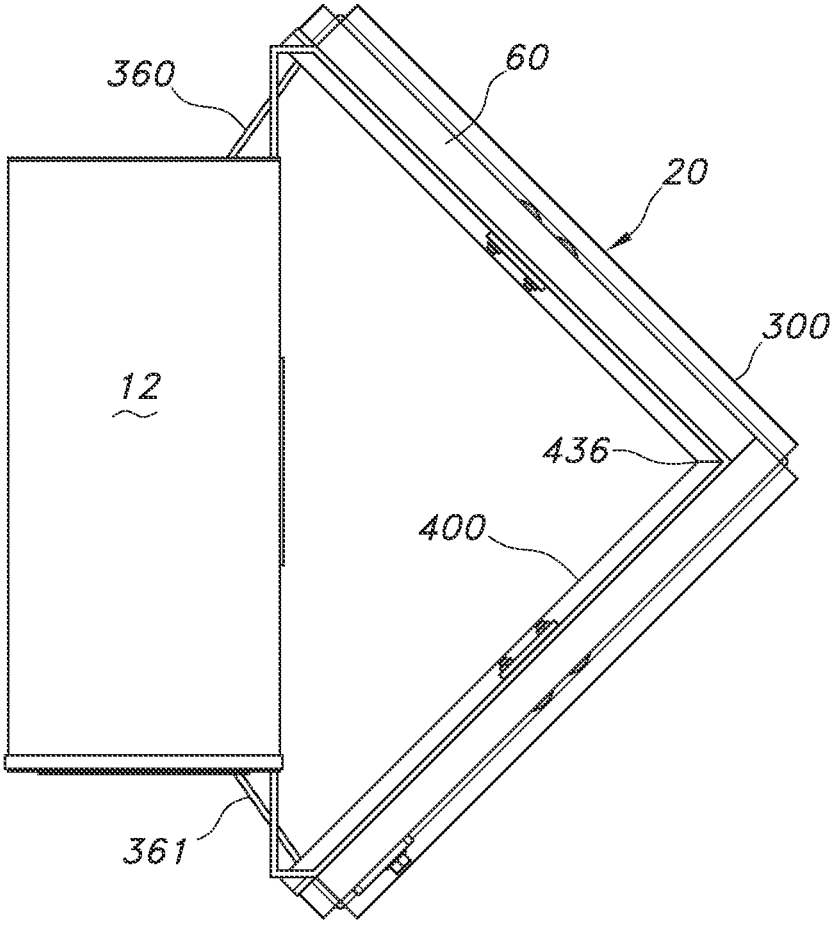
FIG. 7 is a top view of FIG. 1.

The base support 20 (see, FIGS. 8, 9, and 12) has a front plate 300, a rear plate 400, and a frame base 500. The frame base 500 receives a post proximal end (not shown) of the corresponding post 14. The base support 20 has a bottom surface, and the bottom surface can be positioned in a securing substrate at any depth on the condition that the top surface of the corresponding post 14 positioned in the frame base 500 is, as shown in FIG. 3, a distance (d) about 31 inches above the level of the street, as required by the US Postal Service. It is understood that (a) the front plate 300, a rear plate 400, and a frame base 500 could be all embedded in the securing substrate at the same depth; (b) the front plate 300 and a rear plate 400 could be embedded in the securing substrate at a greater depth than the frame base 500; and (c) the front plate 300 and a rear plate 400 could be embedded in the securing substrate at a lesser depth than the frame base 500. However, to make life simpler, the base support 20, the frame base 500 that surrounds and supports a portion of the corresponding post 14 are positioned, when in use to protect a mailbox, in the securing substrate at about the same depth; with the understanding that the term "about" means there can be ±10% differential regarding the depth. Likewise, the phrase "about the same distance" means the differential between the distances embedded in the suitable securing substrate can range from zero to ±5 inches. Suitable securing substrates are, without limitation, dirt, topsoil, clay, mud, sand, rocks, concrete, glass, metal, wood, plastic, anything that is naturally in the ground, anything that is (a) poured and curable (or becomes hardened) or (b) placed in the ground to provide support to the base support 20 or combinations thereof. Preferably the suitable securing substrate is not poured concrete because cured concrete could violate the US Postal Service's safety suggestions. That said, Applicant lists concrete as a possible suitable securing apparatus because Applicant realizes that many individuals and corporations violate safety rules because they erroneously believe that they know more than safety experts. That said, if concrete or other difficult to upend suitable securing substrate 100 (dirt and topsoil are suitable securing substrates that are deemed to be easy to upend) is used, then the post 14 and the at least one post shield board 60 should be notched. The notch is normally located at or near ground level. The notch is added so that when a vehicle hits the post 14 and/or the at least one post shield board 60, then the vehicle can easily break the post 14 and/or the at least one post shield board 60 along the notch to decrease damage to the vehicle, a driver, and, optional, passengers.

Figure 12:
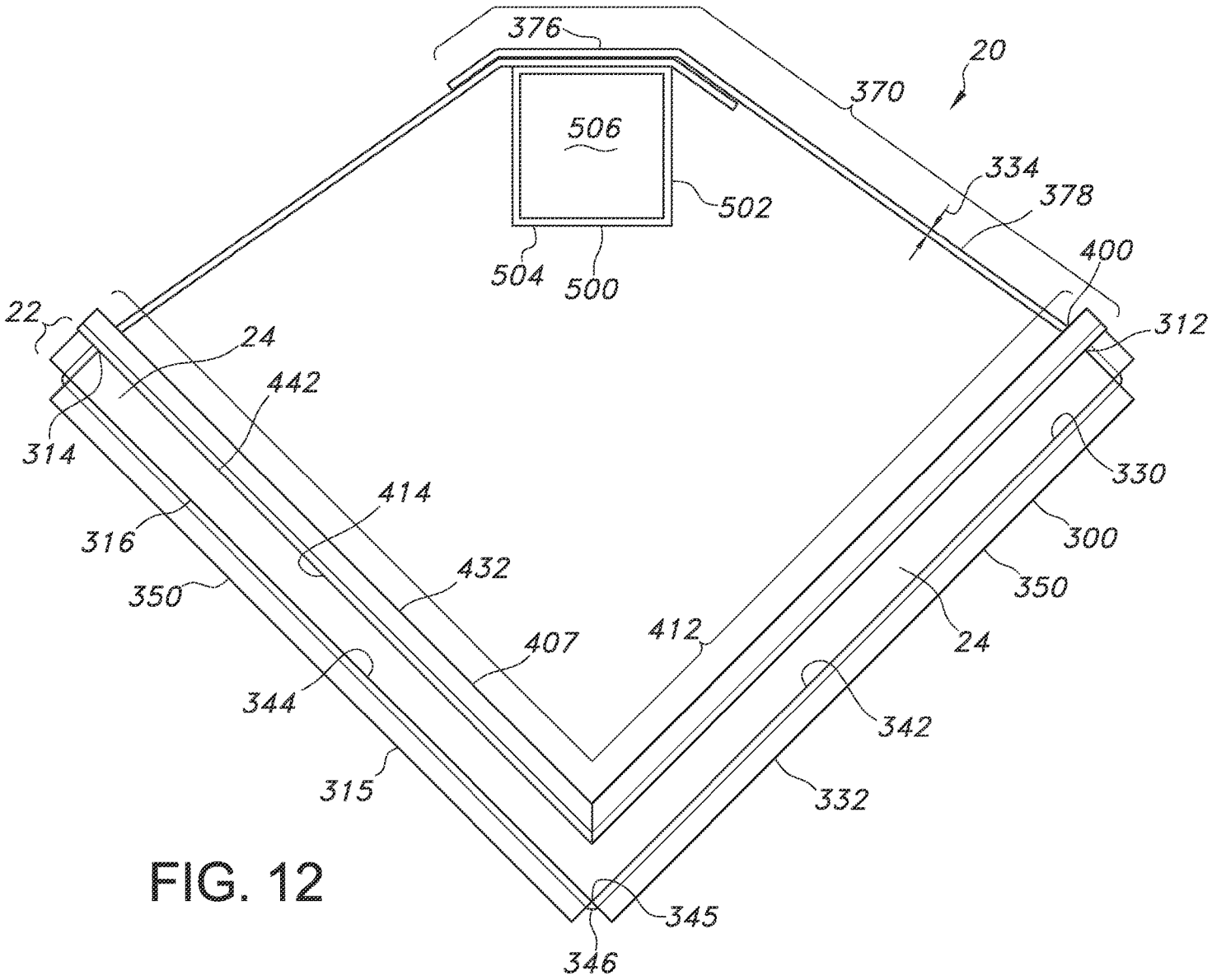
FIG. 12 is a top view of a FIG. 8.

The rear plate 400 is capable of being positioned and is positioned in the securing substrate a post shield distance 22 from the front plate 300 to form a shield aperture 24 (see, FIG. 12). The post shield distance 22 permits the at least one post shield board 60 to be (a) removably received and (b) removed between the front plate 300 and the rear plate 400; and simultaneously provide support to the at least one post shield board 60 so the at least one post shield board 60 essentially stands upright like the mailbox 12 and the corresponding post 14 when properly positioned to receive mail. The post shield distance 22 between the front plate 300 and the rear plate 300 to form the shield aperture 24 depends on the thickness of the at least one post shield board 60. For example and not to be limited to such measurements, the at least one post shield board 60 has a width, a length, and a thickness wherein the thickness of the at least one post shield board 60 is 1-inch, then the post shield distance 22 can be about 1.01-inches to 2-inches, preferably about 1.3 to 1.8 inches; so the at least one post shield board 60 (a) essentially stands upright when positioned in the shield aperture 24, and (b) can be inserted and removed from the shield aperture 24. Obviously, the post shield distance 22 could be greater, yet that greater distance may not permit the at least one post shield board 60 to stand as upright as the US Postal Service would like it. Then again, as confirmed by the public's actions or lack of action between 2020 and 2022; the Applicant realizes the general public does not always believe or abide to expert advice and as such, the post shield distance 22 can be any distance that the general public desires to obtain the desired objective of protecting the mailbox. That said, the Applicant believes that following the US Postal Service's expertise is recommended.

Front Plate—Board Receiving Area

Figure 9:
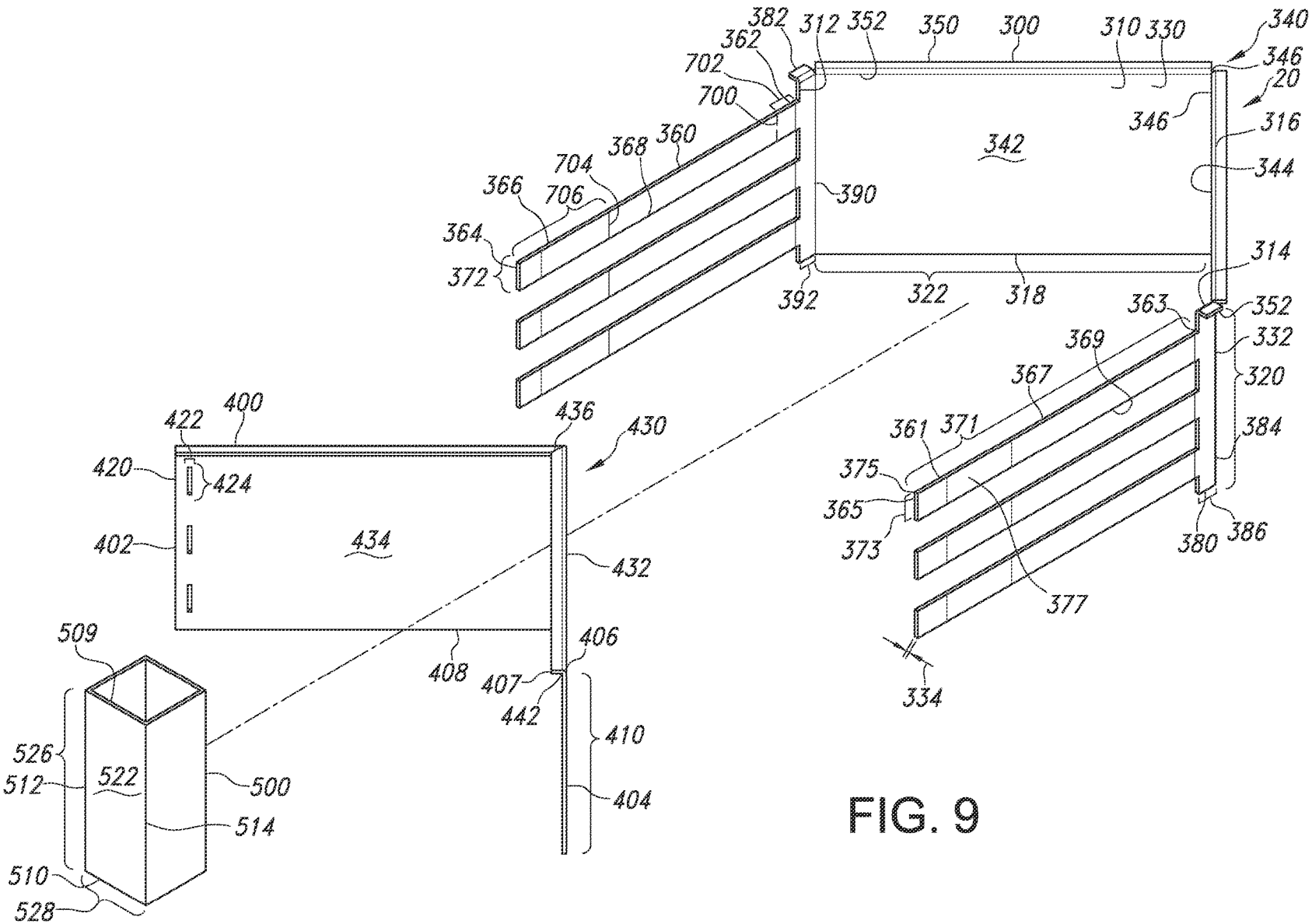
FIG. 9 is an exploded view of FIG. 8.
Figure 10:
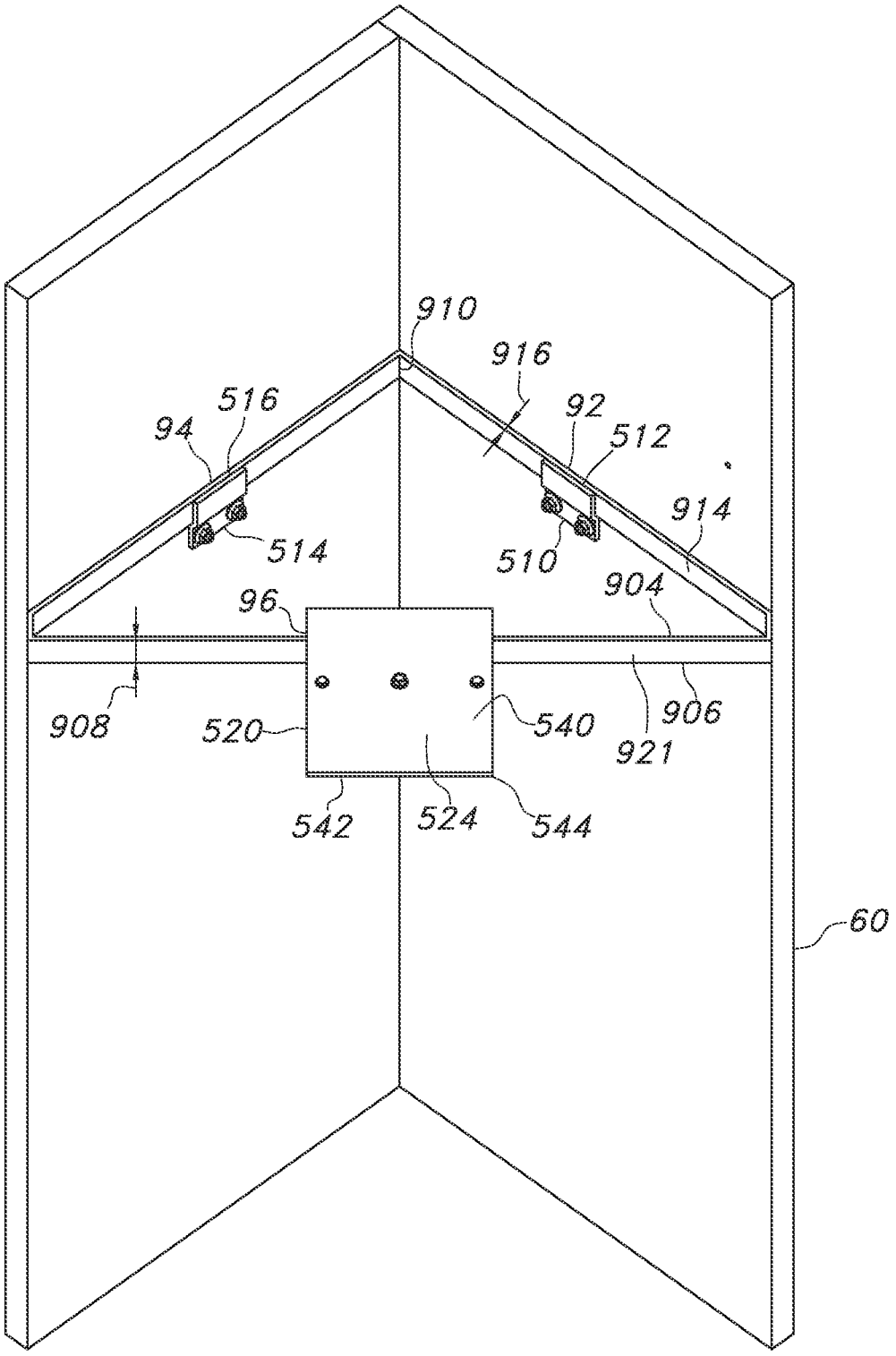
FIG. 10 is a non-traffic side, top, isometric view of at least one post shield board, and an upper frame support.

The front plate 300 has a board receiving area 310 and at least one frame post base support 360 as illustrated at FIG. 9. The board receiving area 310 has a front plate proximal end 312, a front plate distal end 314, a front plate top side 316, and a front plate bottom side 318 wherein collectively the ends 312, 314, and the sides 316, 318 define a front plate height 320, and a front plate length 322. The front plate height 320 and front plate length 322 define the area for a front plate contacting side 330 and for a front plate exterior side 332. The front plate contacting side 330 can contact the at least one post shield board 60 when the at least one post shield board 60 is positioned in the shield aperture 24 when the base support 20 is positioned in the securing substrate. Also, the front plate exterior side 332 and the front plate contacting side 330 are separated by a front plate width 334. The front plate width 334 is normally a uniform distance but it can be a non-uniform distance, and should be greater than 0.1 cm.

The front plate 300 also has a front plate V-shape configuration 340. The front plate V-shape configuration 340 has a front plate first side 342 and a front plate second side 344 separated by a first vertical line 346 (see, FIG. 12). The first vertical line 346 extends from the front plate top side 316 to the front plate bottom side 318 and is positioned at or near the middle of the board receiving area 310 so the front plate proximal end 312 on the front plate contacting side 330 and the front plate distal end 314 on the front plate contacting side 330 are closer to each other than the front plate proximal end 312 on the front plate exterior side 332 and the front plate distal end 314 on the front plate exterior side 332.

In addition, along the first vertical line is at an angle 345 at or near 45° that creates the first or front plate V-shape configuration having the front plate first side 342 and the front plate second side 344 separated by the first vertical line 346.

The front plate 300 has a front plate support 350 (see, FIGS. 9 and 12). The front plate support 350 has a front plate bent distal end 315 and a portion of the front plate 300 that is referred to as the front bend support area 317. The front bend support area 317 of the front plate 300 is bent along a front plate horizontal line 352. The front plate horizontal line 352 extends from the front plate distal end 314 to the front plate proximal end 310 along the front plate top side 316. The distance between the front plate bent distal end 317 and the front plate top side 316 ranges from 1 cm to 10 cm. The front plate support 350 is bent along the front plate horizontal line 352 toward the front plate exterior side 332 to form the front plate support 350. The front plate support 350 is designed to be (i) at ground level, (ii) in, on, or over the securing substrate, and (iii) a distance to inhibit the securing substrate from altering the post shield distance 22 and the shield aperture 24.

The angle of the bend between the front plate support 350 and the front plate exterior side 332 along the front plate horizontal line 352 is an angle at or near 90° in order to create the front plate support 351 (first support).

Front Plate—At Least One Frame Post Base Support

The at least one frame post base support 360 extends from the front plate proximal end 312 between—and does not contact the front plate horizontal line 352—the front plate top side 316, and the front plate bottom side 318. The at least one frame post base support 360, as illustrated at FIG. 9, has a frame post proximal end 362 extending from the front plate proximal end 312, a frame post distal end 364, a frame post top side 366, and a frame post bottom side 368. The frame post proximal end 362, the frame post distal end 364, the frame post top side 366, and the frame post bottom side 368 define a frame post length 370 (see, FIG. 12) and a frame post height 372 (see, FIG. 9). The frame post length 370 and the frame post height 372 define an area for a frame post contacting side 374 and a frame post exterior side 376, see, FIG. 12. The distance between the frame post contacting side 374 and the frame post exterior side 376 define a frame post width 378. The frame post length 370 has a length that permits the at least one frame post base support 360 to be connectable to the frame base 500.

Rear Plate

Likewise, the rear plate 400 (see, FIGS. 8, 9, and 12) has a rear plate proximal end 402, a rear plate distal end 404, a rear plate top side 406, and a rear plate bottom side 408. Collectively the rear plate proximal end 402, the rear plate distal end 404, the rear plate top side 406, and the rear plate bottom side 408 define a rear plate height 410 (see, FIG. 9) and a rear plate length 412 (see, FIG. 12). The rear plate height 410 and the rear plate length 412 define an area for a rear plate contacting side 414 and a rear plate interior side 416. The rear plate contacting side 414 (a) faces the front plate contacting side 330; and (b) can contact the at least one post shield board 60 when the at least one post shield board 60 is positioned in the shield aperture 24. The rear plate contacting side 414 and the rear plate interior side 416 are separated by a rear plate width 418. The rear plate width 418 can be a uniform or non-uniform distance, and should be greater than 0.1 cm.

The rear plate 400 has at least one proximal end tang aperture 420. The at least one proximal end tang aperture 420 is positioned and sized to receive the at least one frame post base support 360. The at least one proximal end tang aperture 420 extends from the rear plate contacting side 414 to the rear plate interior side 416. The at least one proximal end tang aperture 420 has a proximal end tang aperture length 422 that is greater than the frame post width 378, and has a proximal end tang aperture height 424 that is greater than the frame post height 372.

The rear plate 400 also has a rear plate V-shape configuration 430. The rear plate V-shape configuration 430 has a rear plate first side 432 and a rear plate second side 434 separated by a rear plate vertical line 436. The rear plate vertical line 436 extends from the rear plate top side 406 to the rear plate bottom side 408. The rear plate vertical line 436 is also positioned at or near the middle of the rear plate 400 so the rear plate proximal end 402 on the rear plate interior side 416 and the rear plate distal end 404 on the rear plate interior side 416 are closer to each other than the rear plate proximal end 402 on the rear plate contacting side 414 and the rear plate distal end 404 on the rear plate contacting side 414.

Figure 8:
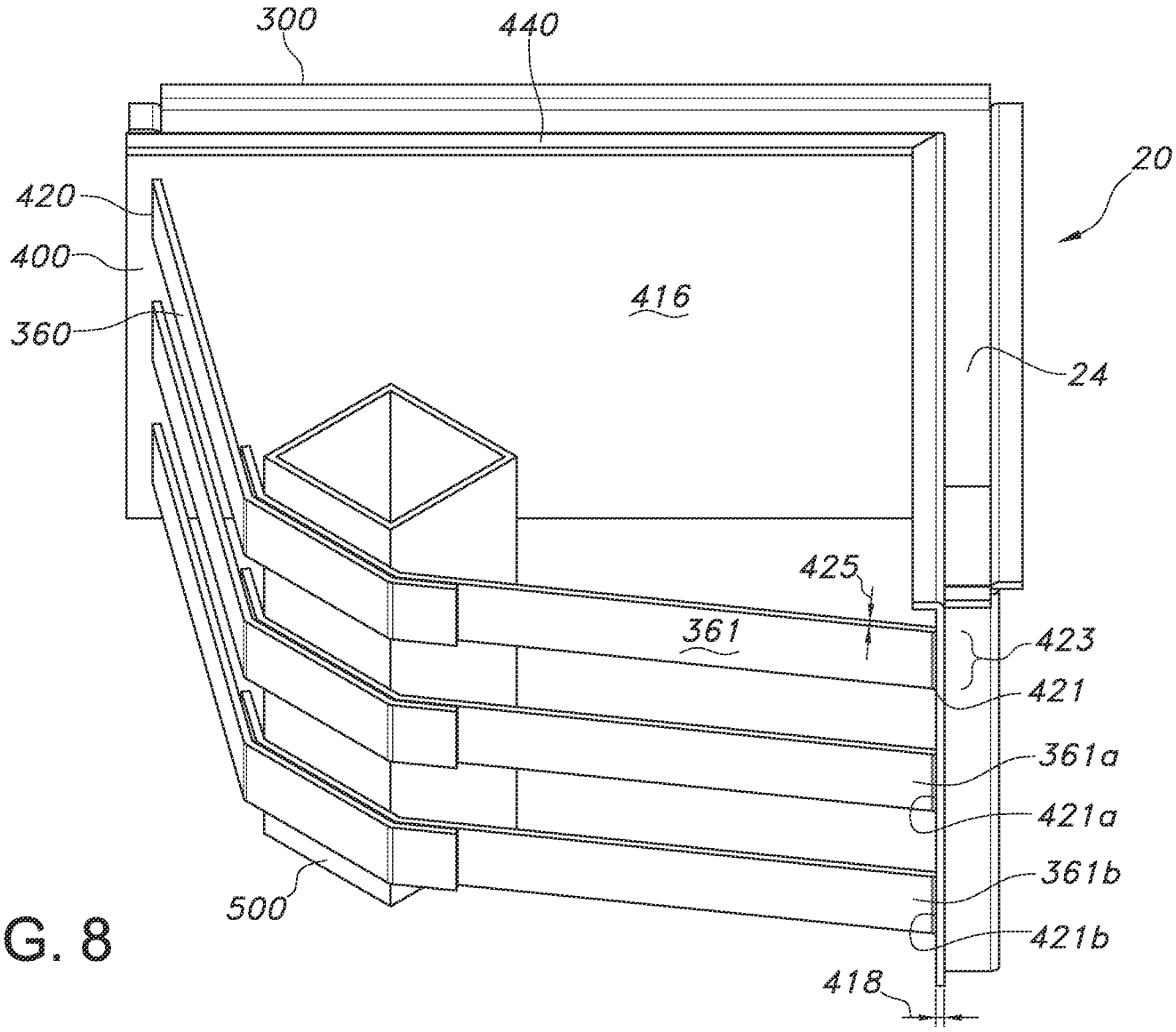
FIG. 8 is a non-traffic side, top, isometric view of a base support of FIG. 1.

The rear plate 400, in addition, has a rear plate support 440, see, FIGS. 8, 9, and 12. The rear plate support 440 has a rear plate bent distal end 407 and a portion of the rear plate 400 that is referred to as the bend support area 409. The bend support area 409 of the rear plate 400 is bent along a rear plate horizontal line 442. The rear plate horizontal line 442 extends from the rear plate distal end 404 to the rear plate proximal end 402 along the rear plate top side 406. The distance between the rear plate bent distal end 407 and the rear plate top side 406 ranges from 1 cm to 10 cm. The rear plate support 440 is bent toward the rear plate interior side 416 to form the rear plate support 440. The rear plate support 440 is designed to be (i) at ground level, (ii) in, on or over the securing substrate, and (iii) to inhibit the securing substrate from altering the post shield distance 22 and the shield aperture 24.

The angle of the bend between the rear plate support 440 and the rear plate interior side 416 along the rear plate horizontal line 442 (second horizontal line) is an angle at or near 90° in order to create the rear plate support 440 (second support).

Frame Base

The frame base 500 (see, FIGS. 1, 2, 3, 5, 6, 8, 9, and 12) is a container 502 having at least one wall 504 surrounding a hollow chamber 506. The hollow chamber 506 is capable of receiving and receives the post proximal end (not shown) of the corresponding post 14. For example, the frame base 500 can be square tubing and made from plastic, metal, wood, concrete, or combinations thereof. In many instances, the frame base 500 is stainless steel. A square tubing of the frame base 500 is sized to receive the post's 14 proximal end in a male-female joint connection, and preferably in a tight-fitting male-female joint connection. The frame base 500 is positioned and is capable of being securely positioned in the securing substrate and as a result, the corresponding post 14 would be securely positioned in the securing substrate.

The frame base 500 has a frame base top side 509, a frame base bottom side 510, a frame base proximal end 512, and a frame base distal end 514. The frame base top side 509, the frame base bottom side 510, the frame base proximal end 512, and the frame base distal end 514 define a frame base height 526 and a frame base length 528. The frame base height 526 and the frame base length 528 define the area of a frame base connecting surface 522. The frame based connecting surface 522 has an interior surface that is able to contact at least a portion of the corresponding post and an exterior surface that is able to contact the securing substrate. Preferably the frame base top side 509 is designed to be at ground level of the securing substrate while the remainder of the frame base 500 is in the securing substrate 100.

Post Shield Board

The at least one post shield board 60 (see, FIGS. 1, 2, 3, 4, 5, 6, 7, 10, 11, and 13) has at least one board proximal end 600, at least one board distal end 602, a board top side 604, and a board bottom side 606. Collectively the at least one board proximal end 600, the at least one board distal end 602, the board top side 604, and the board bottom side 606 define a board height 608, and a board length 610. The board height 608 and the board length 610 define an area for a front board surface 612 (see, FIG. 2) and a rear board surface 614 (see, FIG. 11). The front board surface 612 and the rear board surface 614 are separated by a board width 616—normally ¼ inch to 2 inches, preferably ¾ inches. The board width 616 is (a) less than the post shield distance 22 in the shield aperture 24 to permit the at least one post shield board 60 to be removably received in the shield aperture 24; and (b) simultaneously close to the post shield distance 22 so the at least one post shield board 60 remains and essentially vertical when positioned in the base support 20.

The at least one post shield board 60 also has a shield height 62—as measured from the ground-level 101 of the securing substrate 100 (see, FIG. 3) to the board top side 604 to create an exposed board area 605. The exposed board area 605 is at least equal to a height 66 of a top surface 13 of the mailbox 12 positioned on the corresponding post 14 that extends above ground-level 101. Likewise, the at least one post shield board 60 when being used in the post shield 10 (see, FIGS. 1, 2, and 13) is positioned in the shield aperture 24 and forms a V-shape board configuration 68. The V-shape board configuration has a board first side 70 and a board second side 72. The board first side 70 and the board second side 72 are defined by a linear vertex 73. The linear vertex 73 is directed toward, for example, oncoming traffic to deflect impacting snow away from the mailbox 14. The at least one post shield board 60 can be (a) a single board in the V-shape board configuration, (b) two boards wherein (i) a first board is the board first side 70, (ii) a second board is the board second side 72, and (iii.a) the first board forms the linear vertex 73, (iii.b) the second board forms the linear vertex 73, or (iii.c) a combination thereof; (c) a plurality of boards wherein the board first side 70 can be a single board, two boards, or three or more boards; and the board second side 72 can be a single board, two boards, or three or more boards. Each at least one post shield board 60 can be wood, metal, plastic, or combinations thereof. In addition, it is possible that the at least one post shield board 60 can have advertising thereon.

Moreover, the post shield 10 does not use a stake, fence post, or any other solid structure protruding from the ground level 101 that (a) would violate the US Postal Service's rules and recommendations regarding mailboxes (the corresponding post 14 does not violate the Postal Service rules); (b) connects to or contacts the exposed board area 605 of the at least one post shield board 60, and (c) penetrates the securing substrate 100.

The at least one post shield board 60 has a first upper frame hangman z-bracket 510. The first upper frame hangman z-bracket 510 forms a first upper frame support slot 512 that is adapted to removably receive at least a first portion 92 of the upper frame support 90 (see, FIGS. 11 and 13), and is positioned (a) over the rear plate first side 432 and (b) on (i) the board first side 70 in the exposed board area 605 and (ii) the rear board surface 614. The at least one post shield board 60 has a second upper frame hangman z-bracket 514. The second upper frame hangman z-bracket 514 forms a second upper frame support slot 516 that removably receives at least a second portion 94 of the upper frame support 90, and is positioned (a) over the rear plate second side 434 and (b) on (i) the board second side 72 in the exposed board area 605 and (ii) the rear board surface 614. Additional upper frame hangman z-bracket(s) can be applied to the at least one post shield board 60, in the exposed board area 605 and on the rear board surface 614; and preferably to each board that forms the at least one post shield board 60. The upper frame hangman z-brackets 510, 514 attach to the at least one post shield board 60 through conventional means, such as screws, nails, bolts 580, adhesives, and combinations thereof, with or without washers, nuts, and equivalents thereof.

Mailbox Plate

A mailbox plate 520 (see FIGS. 13 and 9) attaches, preferably removably attaches, to a post distal end 522 of the corresponding post 14. The mailbox plate 510 can be an attachment plate 523 with a J-hook configuration 524 or just the J-hook configuration 524. The J-hook configuration 524 forms a third upper frame support slot 518 that removably receives at least a third portion 96 of the upper frame support 90. The third upper frame support slot 518 is positioned parallel and/or along a side portion 530 of the corresponding post 14. The bottom receiving surface of the third upper frame support slot 518, the second upper frame support slot 516, and the first upper frame support slot 512 are preferably in the same plane 532 so the upper frame support 90 can be easily positioned in each respective upper frame slot 518, 516, and 512.

The mailbox 12 is capable of being removably attached to the corresponding post 14 through conventional attachment means, for example and not limited to screws, bolts, adhesives, nails, or combinations thereof. Those attachment means are standard with any mailbox 12 and corresponding post 14. In this embodiment, a portion of the mailbox plate 520—attachment plate 523—can be positioned between the mailbox 12 and the corresponding post 14.

As alluded to above, the mailbox plate 520 has a plate top surface 540 and a plate bottom surface 542 that are separated by a plate width 544. A first portion of the plate top surface and a first portion of the plate bottom surface are planar and form the attachment plate 523. The first portion of the plate top surface can be positioned to be adjacent to or contact at least a portion of mailbox's bottom surface while the first portion of the plate bottom surface 542 is positioned over at least a portion of the post distal end 522 of the corresponding post 14.

A second portion of the plate top surface and the plate bottom surface forms the J-hook configuration 524. The second portion of the plate top surface forms the third upper frame support slot 518 that removably receives at least the third portion 96 of the upper frame support 90, while a section of the second portion of the plate bottom surface is parallel and/or adjacent to a portion of the corresponding post 14 positioned between the post distal end 522 and the post proximal end 508.

In other embodiments, the J-hook configuration 524 (without the attachment plate 523) can be attached directly onto the corresponding post 14's side surface 530.

Upper Frame Support

The upper frame support 90 has, as indicated above, a minimum three sides. See FIGS. 1, 6, 11, and 13) The first portion 92 is a section of a first side 920 of the upper frame support 90, the second portion 94 is a section of a second side 922 of the upper frame support 90, and the third portion 96 is a section of a third side 924 of the upper frame support 90. As illustrated, there can be additional sides 927, 929 that, for example, ensure the upper frame support 90 has a structure that is protected by the boards 60. The upper frame support 90 has at least one frame proximal end and at least one frame distal end that are joined together, for example, by a weld (not shown in the illustrations), a frame top side 904, and a frame bottom side 906. The distance between (a) the frame top side 904 and the frame bottom side defines a frame height 908, and (b) at least one frame proximal end and at least one frame distal end defines a frame length 910. The frame height 908 and the frame length 910 define an area for (a) a frame contacting side 912 and (b) a frame exterior side 914. The frame contacting side 912 is able to be closer, in relation to the frame exterior side 914, to a part of (a) the at least one post shield board 60 and the corresponding post 14, and (b) in particular, each board of the at least one post shield board 60. The frame contacting side 912 and the frame exterior side 914 are separated by a frame width 916. As illustrated, the upper frame support 90 has, an overall, generic triangle shape (excluding the additional sides 927, 929 that ensure the upper frame 60 is protected by the boards 60), but it can have any shape so long as the upper frame support 90 is able to be inserted into each respective upper frame slot 518, 516, and 512 to provide support to the post shield 10 without violating the US Postal Service's rules and recommendations for a mailbox 12 and corresponding post 14.

Also, the at least one frame proximal end and the at least one frame distal end are, illustrated, as being attached (welded, fastened, joined, riveted and equivalents thereof) to form the above-identified triangular shape. Each side of the upper frame support 90 (as shown in a triangular shape) can have a respective frame proximal end and frame distal end wherein first side's proximal end can be attached to second side's distal end; likewise, the two of the sides can have a single frame proximal end and frame distal end that can be attached to another side having its respective frame proximal end and frame distal end.

Additional Frame Post Base Supports with Rear Plate Additions

The front plate 300 could also have at least two frame post base supports 360, 360*a*, and possibly a third frame post base support 360*b*. Each frame post base support 360, 360*a*, 360*b* is spaced apart from each other frame post base support 360, 360*a*, 360*b*. Likewise, the rear plate 400 has (a) at least one proximal end tang aperture 420 positioned and sized to receive the at least two frame post base supports 360, 360*a*, or possibly all three frame post base supports 360, 360*a*, 360*b*; (b) at least one proximal end tang aperture 420 positioned and sized to receive the at least two frame post base supports 360, 360*a*; and a second proximal end tang aperture 420*a* positioned and sized to receive the third frame post base support 360*b*; (c) at least three proximal end tang apertures 420, 420*a*, 420*b* positioned and sized to receive a respective at least frame post base supports 360, 360*a*, 360*b*, and (d) combinations thereof.

Distal Frame Post Support and Rear Plate Additions

The front plate 300 can have at least one distal frame post base support 361. The at least one distal post base support 361 extends from the front plate distal end 314 between and not contacting the front plate horizontal line 352, and the front plate bottom side 318. The at least one distal frame post base support 361 has a distal frame post base support proximal end 363 extending from and at the front plate distal end 314, a distal frame post base support distal end 365, a distal frame post base support top side 367, a distal frame post base support bottom side 369. The distance between the distal frame post base support proximal end 363 and the distal frame post base support distal end 365 define a distal frame post base support length 371. Likewise, the distance between the distal frame post base support top side 367 and the distal frame post base support bottom side 369 defines a distal frame post base support height 373. The distal frame post base support length 371 and the distal frame post base support height 373 define an area for a distal frame post base support contacting side 375 and a distal frame post base support exterior side 377. The distance between the distal frame post base support contacting side 375 and the distal frame post base support exterior side 377 define a distal frame post width 379. The distal frame post base support length 371 has a length that permits the at least one distal frame post base support 361 to be connectable to the frame base 500 and/or the at least one frame post base support 360.

Likewise, the rear plate 400 has at least one distal tang aperture 421. The at least one distal tang aperture 421 is positioned and sized to receive the at least one distal frame post base support 361. The at least one distal tang aperture 421 extends from the rear plate contacting side 414 to the rear plate interior side 416. The at least one distal tang aperture 421 has a distal tang aperture length 423 greater than the distal frame post width 379, and a distal tang aperture height 425 greater than the distal frame post height 373.

Additional Distal Frame Post Supports and Rear Plate Additions

The front plate 300 has at least two distal frame post base supports 361, 361*a*. Each distal frame post base support 361, 361*a* is spaced apart from each distal frame post base support 361, 361*a*. Likewise, the rear plate 400 has (a) at least one distal end tang aperture 421 positioned and sized to receive the at least two distal frame post base supports 361, 361*a*, or possibly all three frame post base supports 361, 361*a*, 361*b*; (b) at least one distal end tang aperture 421 positioned and sized to receive the at least two distal frame post base supports 361, 361*a*; and a second distal end tang aperture 421*a* positioned and sized to receive the third distal frame post base support 361*b*; (c) at least three distal end tang apertures 421, 421*a*, 421*b* positioned and sized to receive a respective at least one distal frame post base support 361, 361*a*, 361*b*, and (d) combinations thereof.

Bends in Frame Post Base Support

The at least one frame post base support 360 (in addition, 360*a*, 360*b* if used) has a fourth vertical line 700. The fourth vertical line 700 extends from the frame post top side 366 to the frame post bottom side 368, and is positioned a rear plate distance 702 from the frame post proximal end 362, and that rear plate distance 702 is equal to or greater than the rear plate width 418. Along the fourth vertical line 700, the at least one frame post base support 360 is angled at or near 30° toward the frame post contacting side 374.

The at least one frame post base support 360 can also have a fifth vertical line 704. The fifth vertical line 704 extends from the frame post top side 366 to the frame post bottom side 368, and is positioned a frame post distance 706 from the frame post distal end 364 that is equal to or greater than the frame base length 528 of the frame base connecting surface 522. Along the fifth vertical line 704, the at least one frame post base support 360 is angled at or near 10° toward the frame post contacting side 374.

The at least one distal frame post base support 361 (in addition, 361*a*, 361*b* if used) can also have the fourth vertical line 700. The fourth vertical line 700 extends from the distal frame post top side 367 to the distal frame post bottom side 369, and is positioned the rear plate distance 702 from the distal frame post proximal end 363 that is equal to or greater than the rear plate width 418. Along the fourth vertical line 700, the at least one frame post base support 360 is angled at or near 30° toward the distal frame post contacting side 375.

The at least one distal frame post base support 361 has the fifth vertical line 704. The fifth vertical line 704 extends from the distal frame post top side 367 to the distal frame post bottom side 369, and is positioned the frame post distance 706 from the distal frame post distal end 364 that is equal to or greater than the frame base length 528 of the frame base connecting surface 522. Along the fifth vertical line 704, the at least one distal frame post base support 361 is angled at or near 10° toward the distal frame post contacting side 374.

Base Support Additions

The base support 20 and in particular, the front plate 300 further can have a support distal end 380 and a support proximal end 382.

The support distal end 380 is a part of the front plate 300. The front plate 300 has a second vertical line 384 extending from the front plate top side 316 to the front plate bottom side 318. The second vertical line 384 is positioned a first distance 386 from the front plate distal end 314. The first distance 386 is greater than zero centimeters and equal to or less than the post shield distance 22. Preferably, area between the front plate distal end 314 and the second vertical line 384 is bent, along the second vertical line 384, at an angle at or near 90° to create the support distal end 380. In a preferred embodiment, the front plate distal end 314 of the support distal end 380 is capable of contacting or nearly contacting the rear plate 400.

Similarly, the support proximal end 382 is a part of the front plate 300. The front plate 300 has a third vertical line 390 extending from the front plate top side 316 to the front plate bottom side 318. The third vertical line 390 is positioned a second distance 392 from the front plate proximal end 312. The second distance 392 is greater than zero centimeters and equal to or less than the post shield distance 22. Preferably, area between the front plate proximal end 312 and the third vertical line 390 is bent, along the third vertical line 390, at an angle at or near 90° to create the support proximal end 382. In a preferred embodiment, the front plate proximal end 312 of the support proximal end 382 is capable of contacting or nearly contacting the rear plate 400.

Angles

In preferred embodiments, the angle at the rear plate vertical line 436, the rear plate horizontal line 442, the front plate horizontal line 352, the first vertical line 346, the second vertical line 384, and the third vertical line 390 are at an angle at or near 90°.

Figure 13:
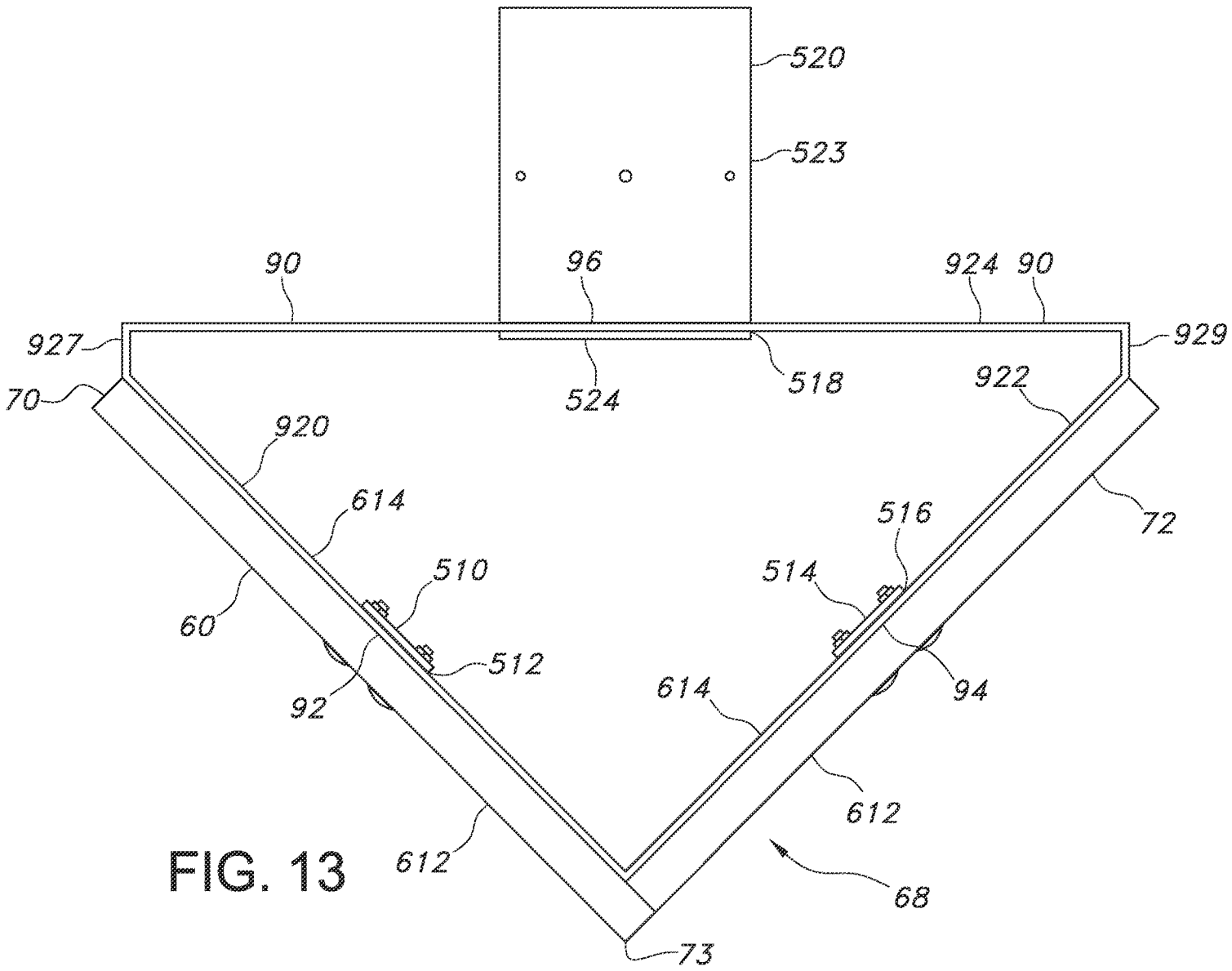
FIG. 13 is a top view of a FIG. 10

If the upper frame support 90 has an essentially a triangular shape as illustrated in FIG. 13, then the upper frame support 90 can have a right angle (90°) between the first side 920 and the second side 922 so that upper frame support's right angle is capable of contacting the rear plate vertical line 436 to provide additional support to the at least one post shield board 60 during the awesome, and hopefully, long winter season.

Spacer

The post shield 10 can also include a spacer. The spacer is capable of being positioned in the shield aperture 24 when the at least one post shield board 60 is not positioned in the shield aperture 24 during the dreary and non-exciting season known as summer which makes it difficult to telemark ski down a mogul run or a couloir.

Kit

The post shield 10 can be disassembled in a kit or a box. The kit or box can contain the base support 20, the at least one post shield board 60, and the upper frame support 90. Alternatively, the kit can include a mailbox 12 and corresponding post 14. Alternatively, the kit can include any attachment mechanisms to secure the post shield in the securing substrate 100, to the corresponding post 14 and the mailbox 12.

Figure 11:
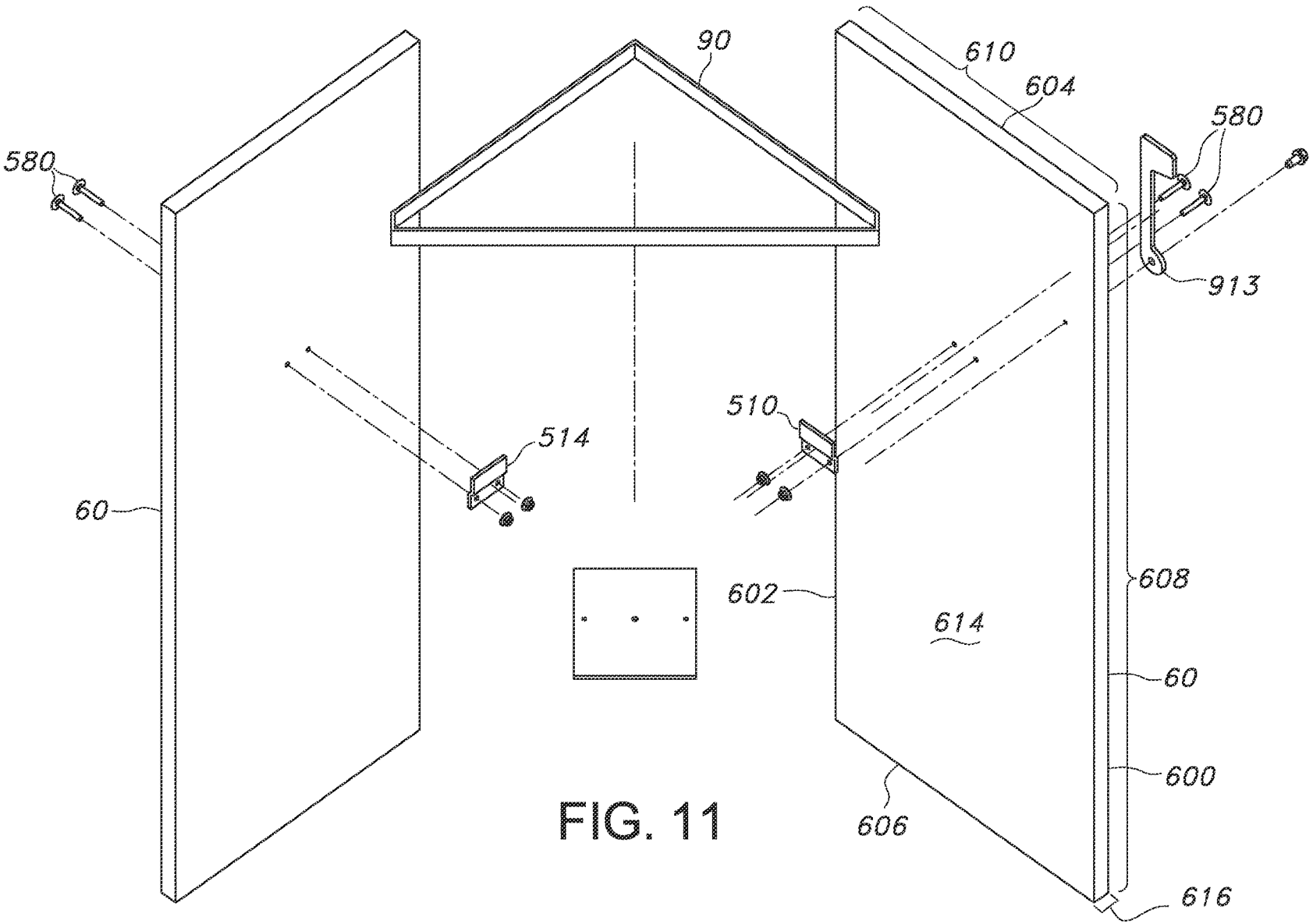
FIG. 11 is an exploded view of FIG. 10.

It is also understood that the location of the post shield 10 should be positioned so it does not interfere with a mail carrier's ability to place mail into the mailbox 12 or remove mail from the mailbox 12. Therefore, the base support 20, that at least one post shield board 60, and the upper frame support 90 are positioned not to interfere with the mail carrier's ability to place mail into the mailbox 12 or remove mail from the mailbox 12. The at least one shield board 60 when positioned in the post shield 10, should not be located between the mailbox's front side and the street. In the US, a properly positioned mailbox (a) is on the right side of a street, (b) has (i) a front side with a latch door that faces the street, (ii) a traffic side that faces the oncoming traffic and normally has a flag thereon—a flag 913 can be added to the board 60 as illustrated in FIG. 11—, (iii) a non-traffic side, (iv) a rear side, (v) a bottom side that attaches to the corresponding post 14, and (vi) the top side 13. The at least one board proximal end 600, as illustrated in FIG. 1, should not (a) be positioned between the street and the mailbox's front side and (b) extend beyond a traffic side plane 970 (see, FIG. 5) that (i) is along the mailbox's traffic side and (ii) goes from the mailbox to the street. The at least one board proximal end 600 terminates at the traffic side plane, or 0.1 to 100 centimeters prior to the traffic side plane. Also, to inhibit snow from being plowed onto the mailbox 12, the at least one board proximal end 600, when properly positioned in the post shield 10, terminates in an area between the mailbox 12 and the street as shown at FIGS. 1, 4, 5, and 6.

The at least one board's distal end 602 can terminate at any position behind the mailbox 12 so plowed snow has a decreased chance of accumulating on the mailbox and corresponding post. The mailbox 12 also has a front side plane that extends along the mailbox's front side, and a rear side plane that extends along the mailbox's rear side. When viewing the mailbox 12 from the traffic side, (a) the area between the right side of the front side plane and the left side of the rear side plane is referred to as the mailbox area; and (b) the area between the street and the left side of the front side plane is defined as the area in front of the mailbox, which means the area behind the mailbox is located on the right side of the rear side plane.

It will be understood that well known processes have not been described in detail and have been omitted for brevity. Although specific steps, structures and materials may have been described, the present disclosure may not be limited to these specifics, and others may substitute as is well understood by those skilled in the art, and various steps may not necessarily be performed in the sequences shown.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The invention claimed is:

1. A post shield designed to protect a mailbox and a corresponding post from damage caused by snow, sleet, ice, or combinations thereof being pushed or pulled toward the mailbox, comprising:

a base support having (a) a front plate, (b) a rear plate capable of being positioned a post shield distance from the front plate to form a shield aperture, the post shield distance permits at least one post shield board to be (i) removably received between the front plate and the rear plate and (ii) vertically aligned when positioned in the shield aperture, and (c) a frame base;

the front plate has (A) a board receiving area (1) having a front plate proximal end, a front plate distal end, a front plate top side, and a front plate bottom side that define a front plate height, and a front plate length for (a) a front plate contacting side that can contact the at least one post shield board, and (b) a front plate exterior side that can contact a securing substrate wherein the front plate contacting side and the front plate exterior side are separated by a front plate width; and (2) has a front plate V-shape configuration, the front plate V-shape configuration has a front plate first side and a front plate second side separated by a first vertical line (a) extending from the front plate top side to the front plate bottom side and (b) positioned at or near the middle of the board receiving area so the front plate proximal end on the front plate contacting side and the front plate distal end on the front plate contacting side are closer to each other than the front plate proximal end on the front plate exterior side and the front plate distal end on the front plate exterior side;

(3) has a front plate support, the front plate support has the front plate top side and portion of the board receiving area bent (a) along a front plate horizontal line (i) positioned between the front plate top side and the front plate bottom side, and a distance below the front plate top side to inhibit the securing substrate from altering the post shield distance and the shield aperture, and (ii) extending from the front plate distal end to the front plate proximal end, and (b) toward the front plate exterior side; and (B) at least one frame post base support (1) extending from the front plate proximal end between and not contacting the first front plate horizontal line, and the front plate bottom side; and (2) having a frame post proximal end extending from the front plate proximal end, a frame post distal end, a frame post top side, and a frame post bottom side define a frame post length and a frame post height for a frame post contacting side and a frame post exterior side, the distance between the frame post contacting side and the frame post exterior side define a frame post width, the frame post length has a length that permits the at least one frame post base support to be connectable to the frame base;

the rear plate (A) has a rear plate proximal end, a rear plate distal end, a rear plate top side, and a rear plate bottom side define a rear plate height and a rear plate length for (i) a rear plate contacting side that faces the front plate contacting side, and (ii) a rear plate interior side, wherein the rear plate contacting side and the rear plate interior side are separated by a rear plate width;

(B) has at least one proximal end tang aperture positioned and sized to receive the at least one frame post base support, the at least one proximal end tang aperture (i) extends from the rear plate contacting side to the rear plate interior side, (ii) has a proximal end tang aperture length greater than the frame post width, and (iii) has a proximal end tang aperture height greater than the frame post height;

(C) has a rear plate V-shape configuration, the rear plate V-shape configuration has a rear plate first side and a rear plate second side separated by a rear plate vertical line (a) extending from the rear plate top side to the rear plate bottom side and (b) positioned at or near the middle of the rear plate so the rear plate proximal end on the rear plate interior side and the rear plate distal end on the rear plate interior side are closer to each other than the rear plate proximal end on the rear plate contacting side and the rear plate distal end on the rear plate contacting side;

(D) has a rear plate support, the rear plate support has the rear plate top side and portion of the rear plate bent (a) along a rear plate horizontal line (i) positioned between the rear plate top side and the rear plate bottom side, and a distance below the rear plate top side to inhibit the securing substrate from altering the post shield distance and the shield aperture, and (ii) extending from the front plate distal end to the front plate proximal end, and (b) along the rear plate horizontal line extending from the rear plate distal end to the rear plate proximal end and (ii) toward the rear plate interior side; and the frame base is a container having at least one wall surrounding a hollow chamber capable of receiving a post proximal end of the corresponding post;

the at least one post shield board has (a) a height above ground-level that is at least equal to a height of the mailbox post box and corresponding post that extends above ground-level;

(b) a first upper frame hangman z-bracket, the first upper frame hangman z-bracket forms a first upper frame support slot that removably receives at least a first portion of an upper frame support, and positioned over the rear plate first side; and (c) a second upper frame hangman z-bracket, the second upper frame hangman z-bracket forms a second upper frame support slot that removably receives at least a second portion of the upper frame support, and positioned over the rear plate second side;

a mailbox plate removably attaches to a post distal end of the corresponding post, the mailbox plate has a J-hook configuration, the J-hook configuration forms a third upper frame support slot that removably receives at least a third portion of the upper frame support;

the upper frame support has (a) at least a first side, at least a second side, and at least a third side, the at least first side includes the first portion, the at least second side includes the second portion, and the at least third side includes the third portion, and (b) at least one frame proximal end, at least one frame distal end, a frame top side, and a frame bottom side that define a frame height, and a frame length, the frame height and the frame length define an area for (a) a frame contacting side that can contact a portion of the at least one post shield board, and (b) a frame exterior side, the frame contacting side and the frame exterior side are separated by a frame width; and the mailbox capable of being removably attached to the corresponding post.

2. The post shield of claim 1 wherein the front plate, the rear plate, the at least one post shield member, the upper frame support, and the frame base are each individually selected from the group consisting of metal, plastic, wood, or combinations thereof.

3. The post shield of claim 1 does not have a stake connecting the post shield into the ground.

4. The post shield of claim 1, wherein along the first vertical line is an angle at or near 45° that creates the first V-shape configuration having the first right side and the first left side separated by the first vertical line.

5. The post shield of claim 1, wherein along the front plate first horizontal line is an angle at or near 90° that creates the first support edge.

6. The post shield of claim 1, further comprising a support distal end and a support proximal end, the support distal end has a second vertical line extending from the front plate top side to the front plate bottom side, the second vertical line is positioned a first distance from the distal end, that first distance is greater than zero centimeters and equal to or less than the post shield distance, along the second vertical line is an angle at or near 90° that creates the support distal end; and the support proximal end has a third vertical line extending from the front plate top side to the front plate bottom side, the third vertical line is positioned a second distance from the proximal end that is greater than zero centimeters and equal to or less than the post shield distance, along the third vertical line is an angle at or near 90° that creates the support proximal end.

7. The post shield of claim 1, wherein the frame post base support has a fourth vertical line, the fourth vertical line (a) extends from the frame post top side to the frame post bottom side, (b) positioned a distance from the frame post proximal end that is equal to or greater than the rear plate width, and (c) has an angle at or near 30° toward the frame post contacting side;

a fifth vertical line, the fifth vertical line (a) extends from the frame post top side to the frame post bottom side, (b) positioned a distance from the frame post distal end that is equal to or greater than the frame base's width, and (c) has an angle at or near 10° toward the frame post contacting side.

8. The post shield of claim 1, wherein the frame base is square tubing.

9. The post shield of claim 1, wherein the mailbox plate has a plate top surface separated from a plate bottom surface;

a first portion of the plate top surface and the plate bottom surface is planar so the first portion of the plate top surface can be adjacent to at least a portion of a bottom surface of the mailbox while the first portion of the plate bottom surface is positioned over at least a portion of the post distal end; and a second portion of the plate top surface and the plate bottom surface forms the J-hook configuration so the second portion of the plate top surface forms an upper frame support slot that removably receives at least the third portion of the upper frame support, while a section of the second portion of the plate bottom surface is adjacent to a portion of the corresponding post positioned between the post distal end and the post proximal end.

10. The post shield of claim 1, wherein the front plate has at least two frame post base supports, and each frame post base support is spaced apart from each frame post base support;

the rear plate has (a) at least one proximal end tang aperture positioned and sized to receive the at least two frame post base supports or (b) at least two proximal end tang apertures wherein each of the at least two proximal end tang apertures is positioned and sized to receive just one of the at least two frame post base supports.

11. The post shield of claim 1, wherein the front plate has at least one distal frame post base support (A) extending from the front plate distal end between and not contacting the front plate first horizontal line, and the front plate bottom side; and (B) having a distal frame post proximal end extending from the front plate distal end, a distal frame post distal end, a distal frame post top side, a distal frame post bottom side, a distal frame post contacting side and a distal frame post exterior side that define a distal frame post width, a distal frame post length, and a distal frame post height, the distal frame post length has a length that permits the at least one distal frame post base support to be connectable to the frame base or the frame post base support; and the rear plate has at least one distal tang aperture positioned and sized to receive the at least one distal frame post base support, the at least one distal tang aperture (i) extends from the rear plate contacting side to the rear plate interior side, (ii) has a distal tang aperture length greater than the distal frame post width, and (iii) has a distal tang aperture height greater than the distal frame post height.

12. The post shield of claim 11, wherein the front plate has at least two distal frame post base supports, and each distal frame post base support is spaced apart from each distal frame post base support;

the rear plate has (a) at least one distal tang aperture positioned and sized to receive the at least two distal frame post base supports or (b) at least two distal tang apertures wherein each of the at least two distal tang apertures is positioned and sized to receive just one of the at least two distal frame post base supports.

13. The post shield of claim 1, wherein the rear plate support edge and the front plate support edge are at or near ground level.

14. The post shield of claim 13, wherein a spacer is positioned in the shield aperture when the at least one post shield board is not positioned in the shield aperture.

15. A kit to make a post shield designed to protect a mailbox and a corresponding post from damage caused by snow, sleet, ice, or combinations thereof being pushed or pulled toward the mailbox, comprising:

a base support having (a) a front plate, (b) a rear plate capable of being positioned a post shield distance from the front plate to form a shield aperture, the post shield distance permits at least one post shield board to be removably received between the front plate and the rear plate, and (c) a frame base;

the front plate has (A) a board receiving area (1) having a front plate proximal end, a front plate distal end, a front plate top side, and a front plate bottom side that define a front plate height, and a front plate length for (a) a front plate contacting side that can contact the at least one post shield board, and (b) a front plate exterior side wherein the front plate contacting side and the front plate exterior side are separated by a front plate width; and (2) has a front plate V-shape configuration, the front plate V-shape configuration has a front plate first side and a front plate second side separated by a first vertical line (a) extending from the front plate top side to the front plate bottom side and (b) positioned at or near the middle of the board receiving area so the front plate proximal end on the front plate contacting side and the front plate distal end on the front plate contacting side are closer to each other than the front plate proximal end on the front plate exterior side and the front plate distal end on the front plate exterior side;

(3) has a front plate support, the front plate support has the front plate top side and portion of the board receiving area bent (a) along a front plate horizontal line (i) positioned between the front plate top side and the front plate bottom side, and a distance below the front plate top side to inhibit the securing substrate from altering the post shield distance and the shield aperture, and (ii) extending from the front plate distal end to the front plate proximal end, and (b) toward the front plate exterior side; and (B) at least one frame post base support (1) extending from the front plate proximal end between and not contacting the front plate first horizontal line, and the front plate bottom side; and (2) having a frame post proximal end extending from the front plate proximal end, a frame post distal end, a frame post top side, and a frame post bottom side define a frame post length and a frame post height for a frame post contacting side and a frame post exterior side, the distance between the frame post contacting side and the frame post exterior side define a frame post width, the frame post length has a length that permits the at least one frame post base support to be connectable to the frame base;

the rear plate (A) has a rear plate proximal end, a rear plate distal end, a rear plate top side, and a rear plate bottom side define a rear plate height and a rear plate length for (i) a rear plate contacting side that faces the front plate contacting side, and (ii) a rear plate interior side, wherein the rear plate contacting side and the rear plate interior side are separated by a rear plate width;

(B) has at least one proximal end tang aperture positioned and sized to receive the at least one frame post base support, the at least one proximal end tang aperture (i) extends from the rear plate contacting side to the rear plate interior side, (ii) has a proximal end tang aperture length greater than the frame post width, and (iii) has a proximal end tang aperture height greater than the frame post height;

(C) has a rear plate V-shape configuration, the rear plate V-shape configuration has a rear plate first side and a rear plate second side separated by a rear plate vertical line (a) extending from the rear plate top side to the rear plate bottom side and (b) positioned at or near the middle of the rear plate so the rear plate proximal end on the rear plate interior side and the rear plate distal end on the rear plate interior side are closer to each other than the rear plate proximal end on the rear plate contacting side and the rear plate distal end on the rear plate contacting side;

(D) has a rear plate support, the rear plate support has the rear plate top side and portion of the rear plate bent (a) along a rear plate horizontal line (i) positioned between the rear plate top side and the rear plate bottom side, and a distance below the rear plate top side to inhibit the securing substrate from altering the post shield distance and the shield aperture, and (ii) extending from the front plate distal end to the front plate proximal end, and (b) along the rear plate horizontal line extending from the rear plate distal end to the rear plate proximal end and (ii) toward the rear plate interior side; and the frame base is a container having at least one wall surrounding a hollow chamber capable of receiving a post proximal end of the corresponding post;

the at least one post shield board has (a) a height above ground-level that is at least equal to a height of the mailbox and corresponding post that extends above ground-level;

(b) a first upper frame hangman z-bracket, the first upper frame hangman z-bracket forms a first upper frame support slot that removably receives at least a first portion of an upper frame support, and positioned over the rear plate first side; and (c) a second upper frame hangman z-bracket, the second upper frame hangman z-bracket forms a second upper frame support slot that removably receives at least a second portion of the upper frame support, and positioned over the rear plate second side;

a mailbox plate removably attaches to a post distal end of the corresponding post, the mailbox plate has a J-hook configuration, the J-hook configuration forms a third upper frame support slot that removably receives at least a third portion of the upper frame support;

the upper frame support has (a) at least a first side, at least a second side, and at least a third side, the at least first side includes the first portion, the at least second side includes the second portion, and the at least third side includes the third portion, and (b) at least one frame proximal end, at least one frame distal end, a frame top side, and a frame bottom side that define a frame height, and a frame length, the frame height and the frame length define an area for (a) a frame contacting side that can contact a portion of the at least one post shield board, and (b) a frame exterior side, the frame contacting side and the frame exterior side are separated by a frame width.

16. The kit of claim 15 further comprising the mailbox and corresponding post.

17. The kit of claim 15 further comprising a spacer that is capable of being positioned in the shield aperture when the at least one post shield board is not positioned in the shield aperture.

* * * * *